US006784778B2

(12) United States Patent
Stitz et al.

(10) Patent No.: US 6,784,778 B2
(45) Date of Patent: Aug. 31, 2004

(54) MAGNET COIL ARRANGEMENT

(75) Inventors: Matthias Stitz, Lohr (DE); Achim Richartz, Lohr (DE)

(73) Assignee: Bosch Rexroth AG, Lohr/Main (DE)

( * ) Notice: Subject to any disclaimer, the term of this patent is extended or adjusted under 35 U.S.C. 154(b) by 114 days.

(21) Appl. No.: 10/276,534

(22) PCT Filed: Apr. 27, 2001

(86) PCT No.: PCT/EP01/04748

§ 371 (c)(1),
(2), (4) Date: Nov. 13, 2002

(87) PCT Pub. No.: WO01/91140

PCT Pub. Date: Nov. 29, 2001

(65) Prior Publication Data

US 2004/0104795 A1 Jun. 3, 2004

(30) Foreign Application Priority Data

May 25, 2000 (DE) ..... 100 25 719
Jul. 10, 2000 (DE) ..... 100 49 709

(51) Int. Cl.[7] ..... H01F 27/02
(52) U.S. Cl. ..... 336/90; 336/192; 336/92
(58) Field of Search ..... 336/92, 90, 96, 336/192, 198, 208, 105, 107, 278, 296

(56) References Cited

U.S. PATENT DOCUMENTS 4,682,136 A * 7/1987 Prokop ..... 335/282
4,683,454 A 7/1987 Vollmer
4,954,801 A * 9/1990 Urbanski et al. ..... 336/90
5,204,044 A * 4/1993 Yoneshige ..... 264/272.15
5,710,535 A * 1/1998 Goloff ..... 336/192
6,076,550 A * 6/2000 Hiraishi et al. ..... 137/550
6,127,912 A * 10/2000 Dust et al. ..... 336/208
6,310,533 B2 * 10/2001 Coulombier ..... 336/90
6,336,818 B1 * 1/2002 Bayer ..... 439/78

FOREIGN PATENT DOCUMENTS

| | | |
|---|---|---|
| DE | 3839692 | 6/1989 |
| DE | 4341087 | 6/1995 |
| DE | 19936425 | 3/2000 |
| DE | 19854100 | 5/2000 |
| EP | 0811995 | 12/1997 |

* cited by examiner

*Primary Examiner*—Anh Mai
(74) *Attorney, Agent, or Firm*—Martin A. Farber

(57) ABSTRACT

In a magnet coil arrangement having a wound coil former and having a metal housing surrounding the wound coil former, contact tabs are held in a plug-in base, one of which serves as a protective conductor connection. The contact tab serving as a protective conductor connection is held on the metal housing by a metallic connecting part. The free spaces between the wound coil former, the metal housing and the plug-in base are encapsulated with plastic. At the interfaces between the metal parts and plastic, moisture can enter the magnet coil arrangement. In order to prevent this moisture from getting into the connecting space, in which electric feed lines coming from the outside are connected to the contact tabs, in the area in which the connecting part engages in the contact tab, the contact tab serving as a protective conductor connection is arranged inside the plug-in base. Between the connecting part and the plug-in base there is arranged a sealing part, of which a first sealing face rests on the connecting part and a second sealing face rests on the plug-in base. The magnet coil arrangement is provided to operate valves which are used in fluid engineering.

13 Claims, 5 Drawing Sheets

MAGNET COIL ARRANGEMENT

FIELD AND BACKGROUND OF THE INVENTION

The invention relates to a magnet coil arrangement, in particular for operating valves.

A magnet coil arrangement of this type is disclosed by DE 43 41 087 C2. A coil former which is provided with an electric winding is arranged in a metal housing. A plug-in base provided with contact tabs is held on the metal housing by a metal connecting part. One of the contact tabs is connected to the metal housing via the connecting part as a protective conductor connection. The ends of the coil windings are connected to two further contact tabs. The free spaces between the wound coil former, the metal housing and the plug-in base are filled with plastic. Moisture can penetrate into the magnet coil arrangement through gaps at the interfaces between the metal housing and the plastic. In order to prevent the moisture entering the connecting space through the plug-in base along the contact tab serving as the protective conductor connection, a sealing ring which encloses the connecting part is provided between the contact tab serving as protective conductor connection and the metal housing. During the assembly preceding the encapsulation, the connecting part is pressed into a recess in the metal housing and into a recess in the contact tab. In the process, the sealing ring is clamped in between the metal housing and the contact tab.

Because of the curvature of the metal housing, the distance between the contact tab and the metal housing in the contact area of the sealing ring is of variable size, so that the sealing ring gives way outwardly to a greater or lesser extent. This leads to nonuniform deformation of the sealing ring over its circumference. The free circumferential surface of the sealing ring, that is to say the area of the sealing ring that is not resting on a metal part comes into contact with the plastic during encapsulation. As a result of the high temperature of the plastic during the encapsulation, the material of the sealing ring is highly thermally stressed. In addition, it is not ensured that, following the curing of the plastic, during which a certain shrinkage always has to be expected, a satisfactory sealing effect between the plastic and the surface of the sealing ring which is free before the encapsulation is ensured. There is therefore the risk that moisture which passes to the sealing ring via a gap between metal housing and the plastic, via a gap between the sealing ring and the plastic adjoining it and via the gap between the contact tab and the plug-in base or via the gap between the contact tab and the plastic, will nevertheless penetrate into the connecting space.

SUMMARY OF THE INVENTION

The invention is based on the object of providing a magnet coil arrangement of the type mentioned at the beginning which prevents liquid which has penetrated into the magnet coil arrangement via a gap between the metal housing and the plastic adjoining the latter being passed on into the connecting space.

In the magnet coil arrangement according to the invention, the sealing part touches neither the contact tab serving as a protective conductor connection nor the metal housing. Since the contact tab runs within the plug-in base in the area in which the connecting part engages in said contact tab, it is sufficient for the sealing part to rest on the connecting part on one side and on the plug-in base on the other side. Since the sealing part has a force applied to it even before the encapsulation of the magnet coil arrangement, the pressure of the plastic during encapsulation and in the following cooling phase plays no part in the sealing effect. In addition, the shrinkage of the plastic during cooling does not play any part in the sealing effect. The sealing part can be arranged between the connecting part and the plug-in base so as to seal both radially and axially.

If the sealing part is arranged to seal radially, it is advantageous to arrange the sealing part in a recess in the plug-in base which is matched to the outer contour of the sealing part, the recess is deeper than the thickness of the sealing part, the sealing part can give way in the axial direction that is to say in the installed state it assumes a substantially oval to egg-shaped cross section. A shoulder on the connecting part ensures that there is a defined distance between the metal housing and the surface of the plug-in base that faces it. If the outer diameter of the shoulder is greater than the inner diameter of the recess, no plastic reaches the sealing part during the encapsulation of the magnet coil arrangement. In addition, the part of the shoulder resting on the plug-in base prevents the connecting part being pulled out of the plug-in base under high tension. As an alternative to a radially sealing arrangement of the sealing part, the invention permits an axially sealing arrangement of the sealing part. In this case, the connecting part is provided with a collar which, when the connecting part is pressed into the contact tab held in the plug-in base, comes into contact with the plug-in base and in this way limits the force acting on the sealing part. In addition, the collar prevents the sealing part coming into contact with the hot plastic during encapsulation if the connecting part is rotationally symmetrical, at least in the sealing area, a commercially available and therefore cost-effective O ring can be used as the sealing part. If one side face of the plug-in base is provided with a projection between the outwardly pointing side and the side of the plug-in base that faces the metal housing, the result is a form-fitting connection which, even when there is high tension on the contact tabs or on the connecting part, prevents the plug-in base being pulled out of the plastic body. One or more recesses on the side of the plug-in base which faces the metal housing, said recesses surrounding the connecting part, improve the sealing effect in the boundary area between the plug-in base and the plastic used for the encapsulation, the recesses making initial melting easier during encapsulation or being effective as a labyrinth seal. If only that section of the contact tab serving as a protective conductor connection in which the connecting part engages is held in the plug-in base, the production of the plug-in base is simplified. Following the production of the plug-in base, the contact tab is pushed into a recess in the plug-in base. In this case, it is advantageous to arrange this recess at right angles to the recess provided for the connecting part. Even better sealing against penetration of moisture into the connecting space may be achieved if the contact tab serving as a protective conductor connection is held only in the plug-in base.

BRIEF DESCRIPTION OF THE DRAWINGS

The invention will be explained in more detail below together with its further details by using exemplary embodiments which are illustrated in the drawings, in which.

DETAILED DESCRIPTION OF THE PREFERRED EMBODIMENT

Figure 1:
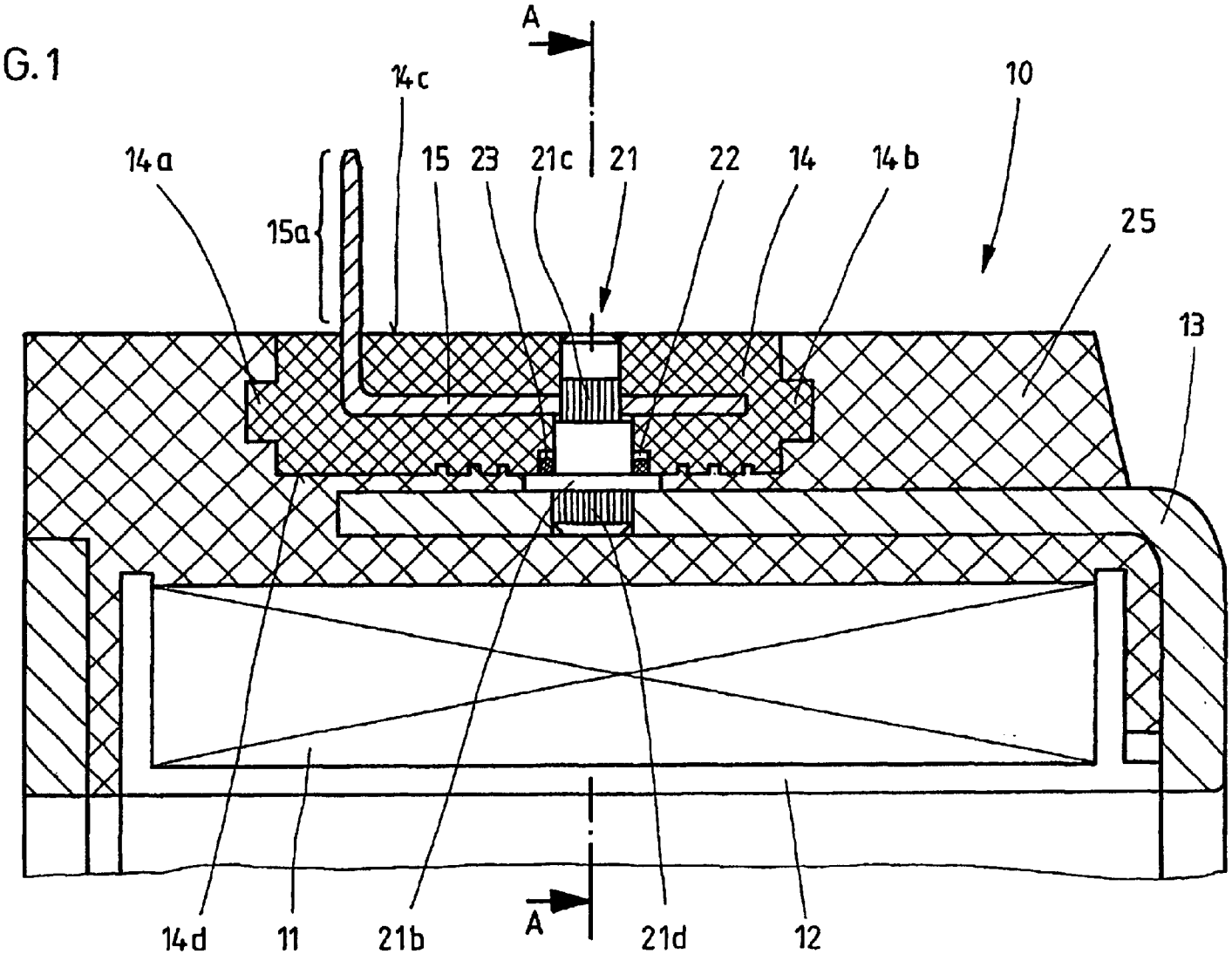
FIG. 1 shows a longitudinal section through part of a first magnet coil arrangement constructed in accordance with the invention.
Figure 2:
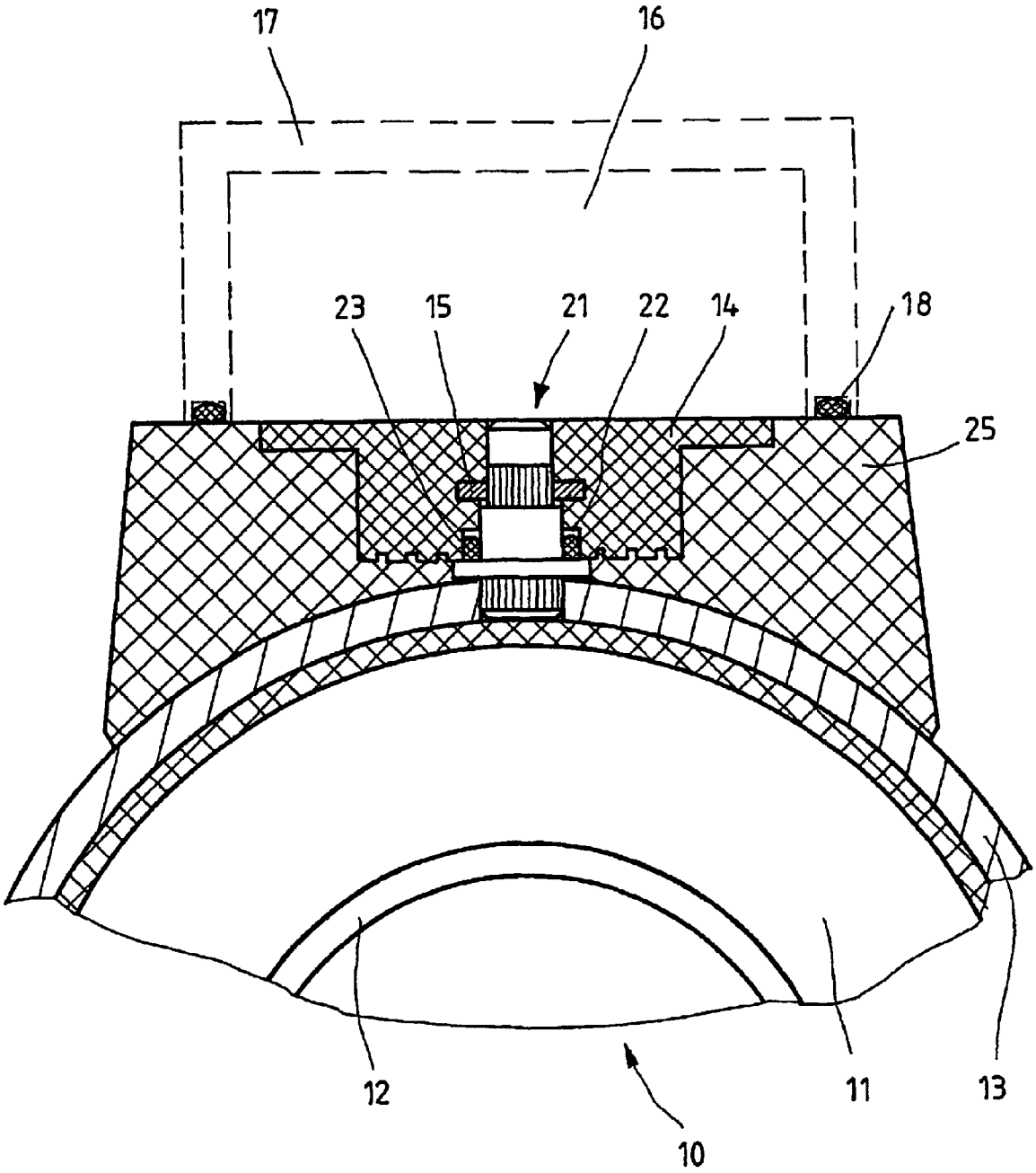
FIG. 2 shows a section along the line A—A in FIG. 1.
Figure 3:
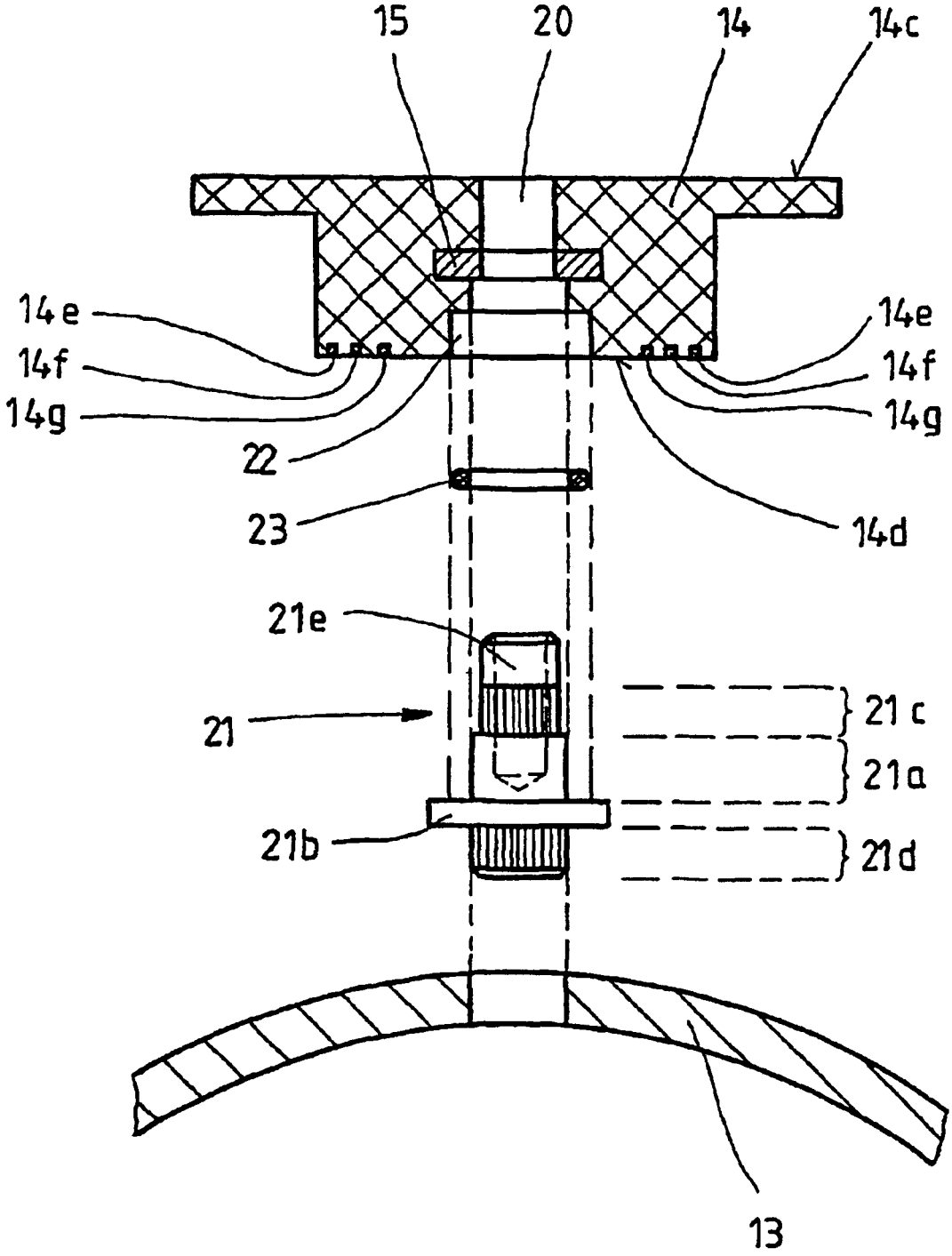
FIG. 3 shows individual parts of the magnet coil arrangement illustrated in FIGS. 1 and 2 in the manner of an exploded drawing.

FIGS. 1 and 2 show various sections through part of a first magnet coil arrangement 10 constructed in accordance with the invention. Here, FIG. 1 shows a longitudinal section through the magnet coil arrangement 10 and FIG. 2 shows a transverse section along the line A—A in FIG. 1. On the basis of FIG. 2, FIG. 3 shows individual parts of the magnet coil arrangement 10 illustrated in FIGS. 1 and 2 in the manner of an exploded drawing for the purpose of clarification. Identical components are provided with the same designations here.

A coil former 12 provided with a winding 11 is surrounded by a pot-like metal housing 13. Arranged in a plug-in base 14 produced from electrically insulating material, for example plastic, are a contact tab 15 serving as a protective conductor connection and further contact tabs, to which the ends of the winding 11 are connected. The further contact tabs and the winding ends are not illustrated in FIGS. 1 to 3, for reasons of clarity. The contact tab 15 is enclosed by the material of the plug-in base 14, apart from the area 15*a* projecting into a connecting space 16. During the production of the plug-in base 14, the contact tab 15 is inserted into the injection mold and then encapsulated with plastic. In FIG. 2, the connecting space 16 is closed off by a cap 17 illustrated schematically. A circumferential seal 18 prevents moisture penetrating into the connecting space 16.

A bolt-like metallic connecting part 21 is arranged in a recess 20. The contact tab 15 is both held mechanically on the metal housing 13 via the connecting part 21 and also connected electrically to said metal housing 13. In a recess 22 in the plug-in base 14, running concentrically with the recess 20 and on the side facing the metal housing 13, an O ring 23 serving as a sealing part is arranged. Both the recess 22 and the sealing area 21*a* of the connecting part 21 have a circular cross section in the sealing area. The inner diameter of the recess 22, the outer diameter of the sealing area 21*a* and the O ring 23 are matched to one another in such a way that the O ring seals radially. In the axial direction of the connecting part 21, the recess 22 is larger than the thickness of the O ring 23. The O ring 23 can therefore give way in the axial direction. A shoulder 21*b*, whose outer diameter is larger than the inner diameter of the recess 22, closes the recess 22. Its thickness determines the distance between the metal housing 13 and the plug-in base 14. As shown in particular by FIG. 2, the shoulder 21*b* rests only linearly on the metal housing 13 because of the curvature of the latter. The connecting part 21 is provided with toothing 21*c*, which is pressed into a corresponding through hole in the contact tab 15. The connecting part 21 is also provided with further toothing 21*d*, which is pressed into a corresponding through hole in the metal housing 13. An internal thread 21*e* makes it possible to fix the cap 17 to the magnet coil arrangement 10 by means of a screw connection. The shoulder 21*b* additionally secures the connecting part 21 against being pulled out of the plug-in base 14.

Before the encapsulation of the magnet coil arrangement 10, the O ring 23 is pushed onto the sealing area 21*a*. The connecting part 21 with the O ring 23 is then pressed into the plug-in base 14 until the shoulder 21*b* rests flush on the plug-in base 14. The recess 22 is therefore closed in such a way that no plastic gets into the recess 22 during the subsequent encapsulation. In a further step, the toothing 21*d* of the connecting part 21 is pressed into the metal housing 13 until the shoulder 21*b* touches the metal housing 13. The contact tab 15 is then electrically connected to the metal housing 13, and the plug-in base 14 is held in a defined position on the metal housing 13 for the encapsulation operation. Following these preparatory steps, the coil former 12 provided with the winding 11 is guided into the metal housing 13, and the ends of the winding 11 are electrically conductively connected to the connecting tabs assigned to them. This structure is encapsulated with plastic in the usual way. In the process, the heated plastic flows into the free spaces and fills them. The areas filled with plastic following the encapsulation, after curing, form a plastic body which, in FIGS. 1 and 2, is provided with the designation 25.

As FIG. 1 illustrates, two side surfaces of the plug-in base 14 are provided with projections 14*a* and 14*b*. The projections 14*a* and 14*b* are arranged between the outwardly pointing side 14*c* and that side 14*d* of the plug-in base 14 which faces the metal housing 13 and are constructed in such a way that even when there is high tension on the plug-in base 14—be it via the contact tab 15, via another contact tab or via the connecting part 21—the plug-in base 14 cannot be pulled out of the plastic body 25.

The side 14*d* of the plug-in base 14 which faces the metal housing 13 is provided with three recesses 14*e*, 14*f*, 14*g*. The recesses 14*e*, 14*f*, 14*g* surround the connecting part 21 concentrically as intrinsically closed grooves. They are used as melting edges which, during the encapsulation of the magnet coil arrangement 10, are initially melted by the hot plastic and fuse to the latter. The melting temperature of the plastic used for the plastic body 25 is selected to be higher for this purpose than the melting temperature of the plastic used for the plug-in base 14. To the extent that complete fusing does not take place or is not intended, the recesses 14*e*, 14*f*, 14*g* serve as labyrinth seals, as they are known, which prevent moisture that has penetrated in being passed on. This makes it possible to seal off the interfaces between the plug-in base 14 and the plastic body 25 reliably against penetration of moisture.

By contrast, there is a different situation at the interfaces between metal and plastic, such as between the metal housing 13 and the plastic body 25 and also between the contact tab 15 and the plug-in base 14. Here, gaps which permit the penetration of moisture cannot be avoided. It is therefore necessary for additional measures to be taken in order that no moisture which has penetrated from the outside via a gap between the metal housing 13 and the plastic body 25, via a gap between the contact tab 15 and the plastic adjacent to the latter and belonging to the plug-in base 14, gets into the connecting space 16. According to the invention, for this purpose the O ring 23 serving as a sealing part is provided, which rests both on the connecting part 21 and on the plug-in base 14 in a radially sealing manner. Moisture which has penetrated via a gap between the metal housing 13 and the plastic body 25 can get only this far. However—as described above—because of the O ring 23, no more moisture can get into the gap between the contact tab 15 and the plug-in base 14, via which moisture would be passed on into the connecting space 16.

The recess 22 and the shoulder 21*b* of the connecting part 21 form a chamber with a circularly annular cross section, in which the O ring 23 is protected against contact with the hot plastic compound during encapsulation. Since the O ring 23 does not come into direct contact with the hot plastic, the thermal stressing of the O ring 23 during encapsulation is only low. In addition, the mechanical stressing of the O ring 23 is low, since it has to seal off only radially but, in the direction of the axis of the connecting part 21, can give way within the recess 22.

Figure 4:
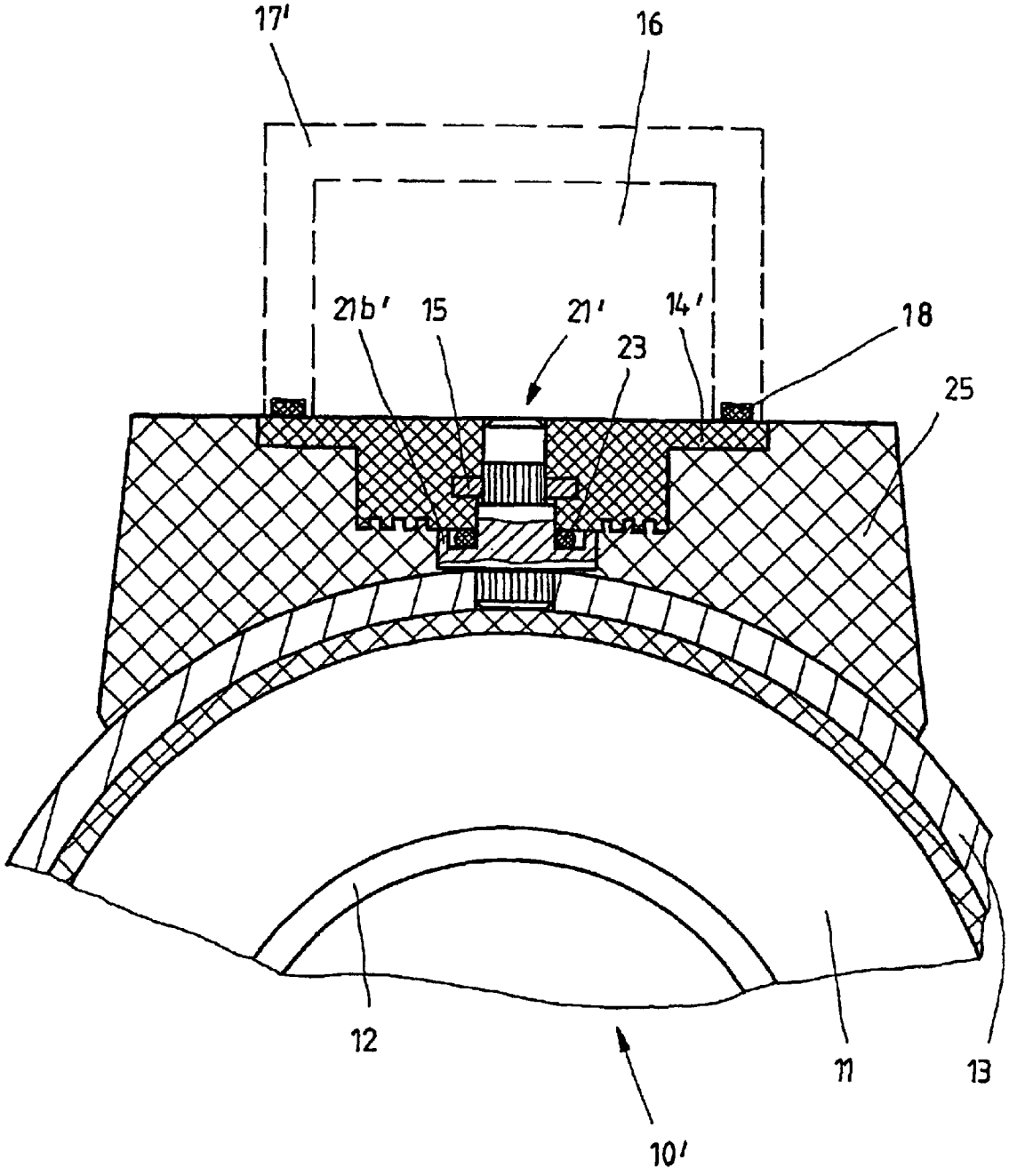
FIG. 4 shows a section corresponding to FIG. 2 through a second magnet coil arrangement according to the invention.

FIG. 4 shows a second magnet coil arrangement 10' according to the invention in an illustration corresponding to FIG. 2. Here, identical parts are provided with the same designations. The cap that seals off the connecting space 16 is provided with the designation 17'. Differing from the cap 17 illustrated in FIG. 2, the cap 17' rests with the seal 18 on the plug-in base 14'. The connecting part between the metal housing 13 and the contact tab 15 is provided with the designation 21'. The O ring 23 is arranged in an axially sealing manner between the plug-in base 14' and a collar 21*b*' of the connecting part 21'. The collar 21*b*' limits the distance between the metal housing 13 and the plug-in base 14'. In addition, the collar 21*b*' determines the distance between the surfaces of plug-in base 14' and connecting part 21', on which the O ring 23 rests. Therefore, the force acting on the O ring 23 in the direction of the axis of the connecting part 21' is limited. It is not necessary for the O ring 23 also to rest on the connecting part 21' so as to seal in the radial direction, since the sealing effect is already provided by the force acting on the O ring 23 in the axial direction. Since the inner diameter of the collar 21*b*' is larger than the outer diameter of the O ring 23, the O ring 23 can give way in the radial direction when acted on by an axial force. The collar 21*b*, additionally prevents the O ring 23 coming into contact with the hot plastic during encapsulation. In this exemplary embodiment, too, moisture which has penetrated via a gap between the metal housing 13 and the plastic body 25 can get only as far as the O ring 23. Because of the sealing provided by the O ring 23, however, moisture which has penetrated cannot get further into the gap between the contact tab 15 and the plug-in base 14', via which the moisture would then be passed on into the connecting space 16.

Figure 5:
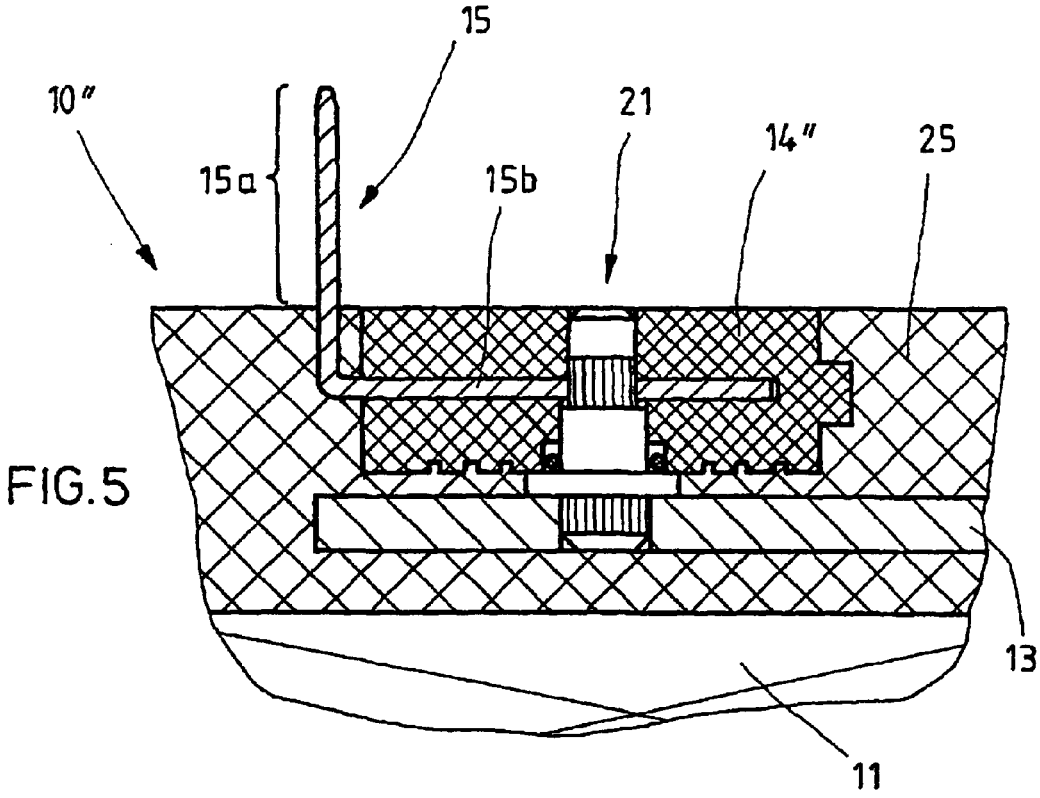
FIG. 5 shows a section corresponding to FIG. 1 through a third magnet coil arrangement according to the invention.
Figure 6:
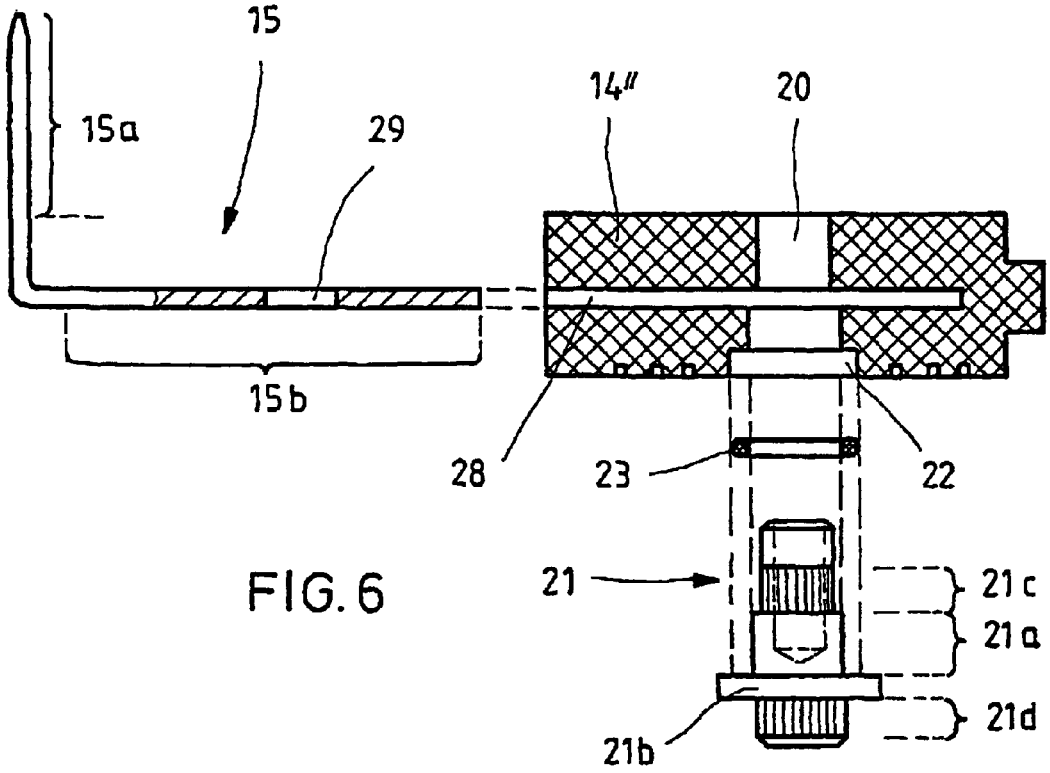
FIG. 6 shows individual parts of the magnet coil arrangement illustrated in FIG. 5 in the manner of an exploded drawing.

FIGS. 5 and 6 show various sections through part of a third magnet coil arrangement 10" constructed in accordance with the invention. In this case, FIG. 5 shows a section corresponding to FIG. 1 through the magnet coil arrangement 10". FIG. 5 shows only that detail in which the magnet coil arrangement 10" differs from the magnet coil arrangement 10 illustrated in FIG. 1. For the purpose of illustration, FIG. 6 shows individual parts of the magnet coil arrangement 10" illustrated in FIG. 5 in an exploded drawing corresponding to FIG. 2. Identical components are provided with the same designations.

The third magnet coil arrangement 10" differs from the magnet coil arrangements 10 and 10' illustrated in FIGS. 1 to 4 with regard to the arrangement of the contact tab 15 in the plug-in base. In FIGS. 5 and 6, the latter is provided with the designation 14". While, in the magnet coil arrangements 10 and 10', the contact tab 15 is injection-molded into the plug-in base 14 (FIGS. 1 to 3) and 14' (FIG. 4), the plug-in base 14" is provided with an additional recess 28, which is arranged at right angles to the recess 20 to accommodate the connecting part 21. The recess 28 is used to accommodate the region of the contact tab 15 provided with the designation 15*b*. The region 15*b* is provided with a through hole 29. This arrangement has the advantage that the contact spring 15 does not need to be inserted into the injection mold during the production of the plug-in base 14". The contact tab 15 is only inserted into the recess 20 in the plug-in base 14" before the encapsulation of the magnet coil arrangement 10". After the O ring 23 has been pushed onto the connecting part 21 until it makes contact with the shoulder 21*b*, the connecting part 21 with the O ring 23 is pushed into the recess 20, and the contact area 21*c* of the connecting part 21 is pressed into the through hole 29 in the contact tab 15 until the shoulder 21*b* rests on the plug-in base 14". The contact tab 15 is therefore secured against slipping out of the plug-in base 14" during the further processing steps. After the toothing 21*d* of the connecting part 21 has been pressed into the metal housing 13, the further processing steps follow, as already described in connection with FIG. 3.

The cap surrounding the connecting space is not illustrated in FIG. 5. As illustrated in FIG. 2, it has to be constructed in such a way that it rests on the plastic body 25.

We claim:

1. A magnet coil arrangement, in particular for operating valves, comprising a wound coil former, a metal housing surrounding the wound coil former, a plug-in base provided with contact tabs, one of which serves as a protective conductor connection, a metallic connecting part which is arranged between the metal housing and the contact tab serving as protective conductor connection and which engages in a recess in the metal housing and in the contact tab serving as protective conductor connection, an annular sealing part surrounding the connecting part and wherein free spaces between the wound coil former, the metal housing and the plug-in base are filled with plastic, wherein the contact tab (15) serving as protective conductor connection is arranged inside the plug-in base (14; 14'; 14") in an area in which the connecting part (21; 21') engages in said contact tab (15), and the sealing part (23) is arranged in a sealing manner between the connecting part (21, 21') and the plug-in base (14; 14'; 14").

2. The magnet coil arrangement as claimed in claim 1, wherein the sealing part (23) is arranged between the connecting part (21) and the plug-in base (14; 14") so as to seal in radial direction.

3. The magnet coil arrangement as claimed in claim 2, wherein on a side facing the metal housing (13), the plug-in base (14; 14") is provided with a recess (22) matched to an outer contour of the sealing part (23).

4. The magnet coil arrangement as claimed in claim 3, wherein the recess (22) is deeper than thickness of the sealing part (23).

5. The magnet coil arrangement as claimed in claim 4, wherein an outer diameter of a shoulder (21*b*) of the connecting part (21) is larger than diameter of the recess (22).

6. The magnet coil arrangement as claimed in claim 1, wherein the connecting part (21) is provided with a shoulder (21*b*) between a part (21*d*) that engages in the metal housing (13) and a part (21*a*) which is enclosed by the sealing part (23).

7. The magnet coil arrangement as claimed in claim 1, wherein the sealing part (23) is arranged between the connecting part (21') and the plug-in base (14') so as to seal in axial direction, wherein the connecting part (21') is provided with a collar (21*b*') which presses the sealing part (23) in the axial direction against the plug-in base (14'), and the collar (21*b*') encloses the sealing part (23) laterally.

8. The magnet coil arrangement as claimed in claim 1, wherein the connecting part (21; 21') is rotationally symmetrical, and the sealing part (23) is an O ring.

9. The magnet coil arrangement as claimed in claim 1, wherein at least one side surface of the plug-in base (14) is provided with a projection (14*a*, 14*b*) between an outwardly pointing side (14*c*) and a side (14*d*) of the plug-in base (14) which faces the metal housing (13).

10. The magnet coil arrangement as claimed in claim 1, wherein a side (14*b*) of the plug-in base (14) which faces the metal housing (13) is provided with at least one recess (14*e*, 14*f*, 14*g*) surrounding the connecting part (21).

11. The magnet coil arrangement as claimed in claim 1, wherein the plug-in base (14") is provided with a first recess (20) to accommodate the connecting part (21) and with a second recess (28) to accommodate a region of the contact tab (15) which serves as the protective conductor connection, in which the connecting part (21) engages.

12. The magnet coil arrangement as claimed in claim 11, wherein the second recess (28) is arranged at right angles to the first recess (20).

13. The magnet coil arrangement as claimed in claims 1, wherein the contact tab (15) serving as the protective conductor connection runs only in the plug-in base 14; 14').

* * * * *